US007307916B2

(12) United States Patent
Vogt et al.

(10) Patent No.: US 7,307,916 B2
(45) Date of Patent: Dec. 11, 2007

(54) WORLD TIMEPIECE

(75) Inventors: Michael Vogt, Cortaillod (CH); Thomas Prescher, Twann (CH); Renato Scarinzi, Biel (CH)

(73) Assignee: Powermike.com L.P., Edinburgh (GB)

( * ) Notice: Subject to any disclaimer, the term of this patent is extended or adjusted under 35 U.S.C. 154(b) by 197 days.

(21) Appl. No.: 10/537,494

(22) PCT Filed: Dec. 8, 2003

(86) PCT No.: PCT/CH03/00807

§ 371 (c)(1),
(2), (4) Date: Jun. 3, 2005

(87) PCT Pub. No.: WO2004/053599

PCT Pub. Date: Jun. 24, 2004

(65) Prior Publication Data

US 2006/0285443 A1 Dec. 21, 2006

(30) Foreign Application Priority Data

Dec. 6, 2002 (CH) ..... 2065/02

(51) Int. Cl.
*G04B 19/22* (2006.01)

(52) U.S. Cl. ..... 368/21; 368/295

(58) Field of Classification Search ..... 368/22, 368/23, 24, 25, 26, 27, 21, 49, 184–185
See application file for complete search history.

(56) References Cited

U.S. PATENT DOCUMENTS 2,013,765 A * 9/1935 Richardson ..... 267/174
4,253,177 A * 2/1981 Hafner ..... 368/187
5,383,165 A * 1/1995 Vaucher ..... 368/27

(Continued)

FOREIGN PATENT DOCUMENTS

| | | |
|---|---|---|
| CH | 283 822 A | 6/1952 |
| CH | 662 234 A | 9/1987 |
| DE | 814 426 C | 9/1951 |
| EP | 0 769 733 A1 | 4/1997 |

*Primary Examiner*—Vit Miska
*Assistant Examiner*—Sean Kayes
(74) *Attorney, Agent, or Firm*—Finnegan, Henderson, Farabow, Garrett & Dunner, LLP

(57) ABSTRACT

A mechanical world timepiece having a transmission mechanism which allows the time display, such as, for example, a 12-hour hand and/or a 24-hour hand, to be directly adjusted with a turning ring having 24 time zones. The timepiece serves for the easily manageable adjustment of the time zone and the reading of the time in a different time zone. Operation could not be simpler. After a lever has been opened, the mechanism in FIG. 1 automatically engages. The gear rim (6), which is fixed with the turning ring, drives a vertical drive wheel (5), which is connected by a shaft to a clutch wheel (4). Once the pinion (4) is engaged, it drives one or two minute wheels (8, 9), which move a 12-hour wheel (10) and a 24-hour wheel (11) in a 1 h-cycle. The turning ring is thus easily turned to the desired destination at 12 h and the local time can immediately be read. Either the turning ring is now turned back to its original locality or the lever is simply closed. In the latter case, the time now continues running according to the set destination. The push-piece (2) disengages the mechanism via a rocker (3), simultaneously fixes, in the closed state, the gear rim (6) and prevents accidental adjustment of the time. The transmission mechanism can also be used for setting or changing other time displays, such as date, day of the week, month, year, minutes, or for other functions such as an alarm.

12 Claims, 7 Drawing Sheets

U.S. PATENT DOCUMENTS 5,524,102 A * 6/1996 Liao et al. ..... 368/21
5,708,628 A * 1/1998 Chen ..... 368/21
5,742,565 A * 4/1998 Cuinet et al. ..... 368/190
6,200,019 B1 * 3/2001 Latini ..... 368/289
6,379,037 B1 * 4/2002 Saleh et al. ..... 368/185
6,579,004 B1 * 6/2003 Kim ..... 368/295
6,679,624 B1 * 1/2004 Mouawad ..... 368/216
7,134,784 B1 * 11/2006 Marin ..... 368/295

* cited by examiner

WORLD TIMEPIECE

PRIOR ART

There are a small number of mechanical world time pieces or, indeed, GMT timepieces, both digital and analog. The most frequent models with a mechanical movement have an additional hand, which, on a 24 h dial, allows a second time zone to be read. The drawback with such models is the unaccustomed time display of this additional hand, for the habitual pattern of behavior is to read the time on an analog 12 h dial.

These models also frequently have a time zone ring, which, either as a turning ring or as a ring, is fastened in the dial and rotates. The time zone ring contains 24 destinations. This allows the user to read the time simultaneously in 24 time zones. The drawback is once again, however, that the reading of the individual time zones is complicated and does not conform to the habitual pattern of behavior, so that mistakes are often made in reading.

For some years there have also been GMT timepieces having a push-piece which allows the hour hand to be advanced or put back, by pushing, in a 1 h cycle. Although the analog readability is thereby improved, the drawback exists that these GMT timepieces are not easily manageable and that the sequential resetting of the time in the 1 h cycle is laborious and lengthy.

OBJECT

The object of the present invention is therefore to develop the most complete and user-friendly world timepiece which has ever existed on a mechanical basis. This implies the following:

- Optimal ease of use: The user must be able to change into any time zone with maximum simplicity and speed and to read the time there.
- Optimal readability: the timepiece must display the time in the set destination in accordance with the habitual analog pattern of behavior.
- Artisana Horlogère: This timepiece is intended to be driven via a mechanical wheel train located in a water-tight housing.

Requirements:

Only one time is intended ever to be displayed, i.e. there is either a home time or a destination time.

The timepiece has a turning ring with 24 locality designations. The locality designations are listed according to their official deviation from the zero meridian and have an indication as to whether there is an official DST (daylight saving time) at this locality.

The turning ring can be turned both in the clockwise and in the counterclockwise direction. It engages according to the time zones at 24 positions. When it is turned to the right, the hour hands move forward; when it is turned to the left, the hour hands move back. Optionally, this principle can also be reversed, i.e. when the turning ring is turned to the right, the hour hands move back; when it is turned to the left, they move forward.

The turning ring is lockable, so that the time zone cannot be inadvertently adjusted.

When the turning ring is turned, the hour hands adjust directly and synchronously to the locality located at 12 o'clock on the turning ring.

Working Principle:

The inventive achievement of these objects emerges from the features in claim 1.

In order to allow the interaction between turning ring and hour hand, a wheel train has been designed and developed which can be engaged and disengaged from outside the housing and simultaneously guarantees watertightness. (See FIG. 6)

The coupling operation is actuated via a lever on the housing. It is opened or closed by means of a device such as, for example, a lever connected to the housing.

In the closed state, the lever, by virtue of its shape and with the shape of the turning ring, locks the turning ring. If the lever is not used to lock the turning ring, this is done through the shape of the push-piece.

If the lever is open, the turning ring can be turned in both directions.

The lever operates a push-piece. This push-piece operates, in turn, a further lever, the clutch rocker, which engages and disengages the mechanism.

When the lever is open, the mechanism is engaged and the user can turn the desired locality on the turning ring to 12 h. The displayed time corresponds to that of the locality on the turning ring at 12 o'clock.

The 24-hour hand, which rotates synchronously with the 12-hour hand once every 24 hours and has its own number scale, provides the user with information on whether it is day or night in the set destination.

A further innovation is the consideration given to the summer and wintertime display (=DST, Daylight Saving Time). All localities which bring in a statutory summer or wintertime are marked with a symbol on the turning ring. If it is now summertime for a particular locality, the user must set the DST symbol for the corresponding locality to the 12 o'clock position and the current time for the locality is displayed by the hands.

LIST OF DRAWINGS

DETAILED FUNCTIONAL DESCRIPTION

Figure 1:
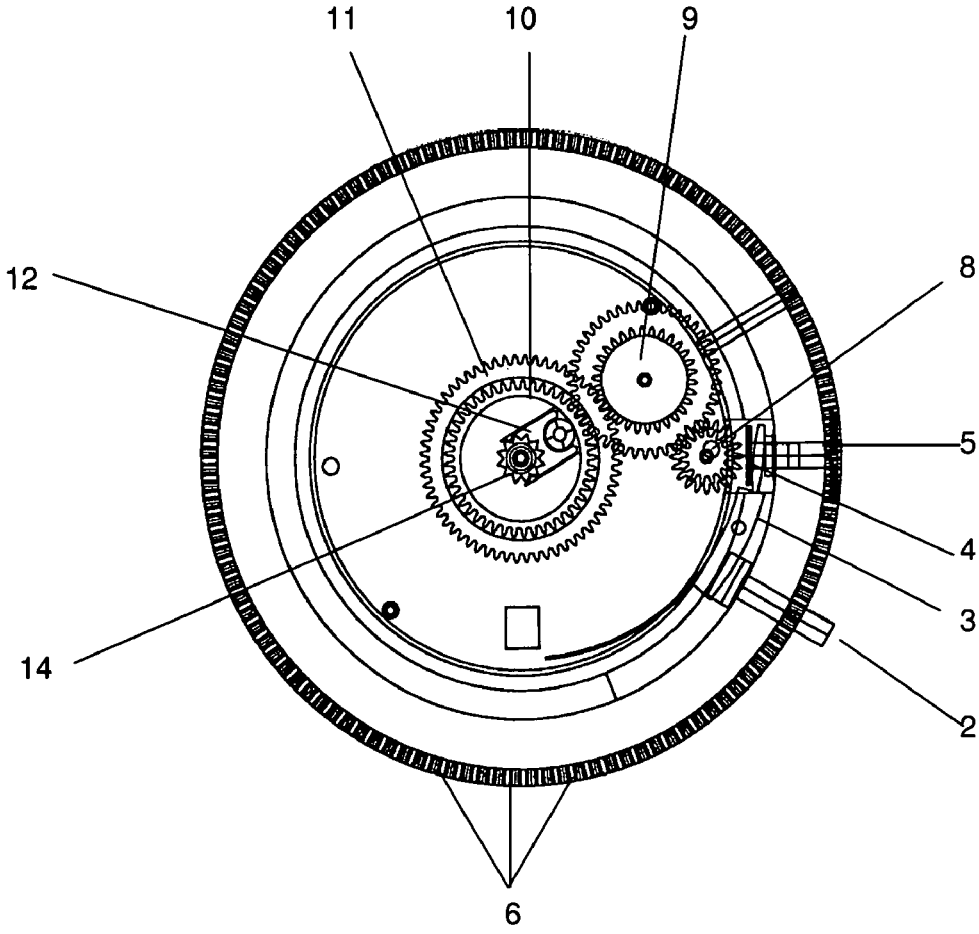
FIG. 1 shows a 3D-view of the transmission mechanism
Figure 6:
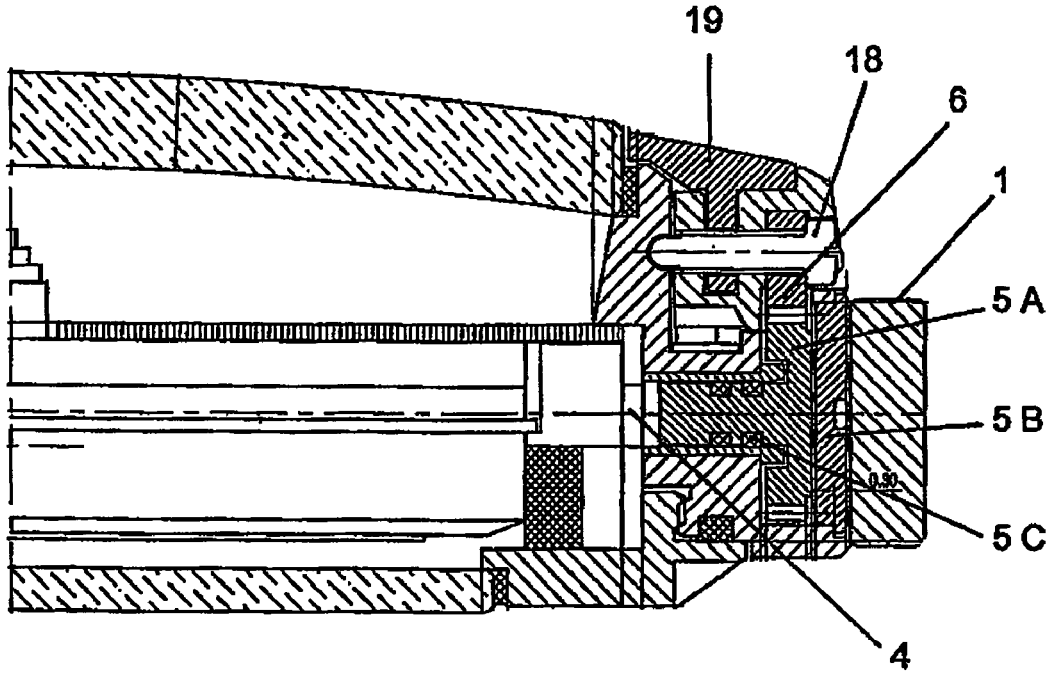
FIG. 6 shows a cross section 3H of the timepiece. It shows how the watertightness has been achieved, and the principle of a turning ring with an exchangeable insert.

The turning ring in FIG. 1 has a bottom-fixed spur gear wheel (6), which drives a vertically mounted wheel (5) in the housing, which wheel, for its part, drives a clutch wheel (4). The pinions (4, 5) are mutually connected by a shaft. FIG. 6 shows that the housing and the gear wheel have been designed such that this vertical wheel (5A) is 'concealed' within the outer side of the housing and is connected by a sealed axle (5C) to a clutch wheel (4), thereby producing the watertightness. The cap (5B) seals the drive wheel against the outside. The drive wheel (5A) is always connected to the gear rim ring (6).

Figure 2:
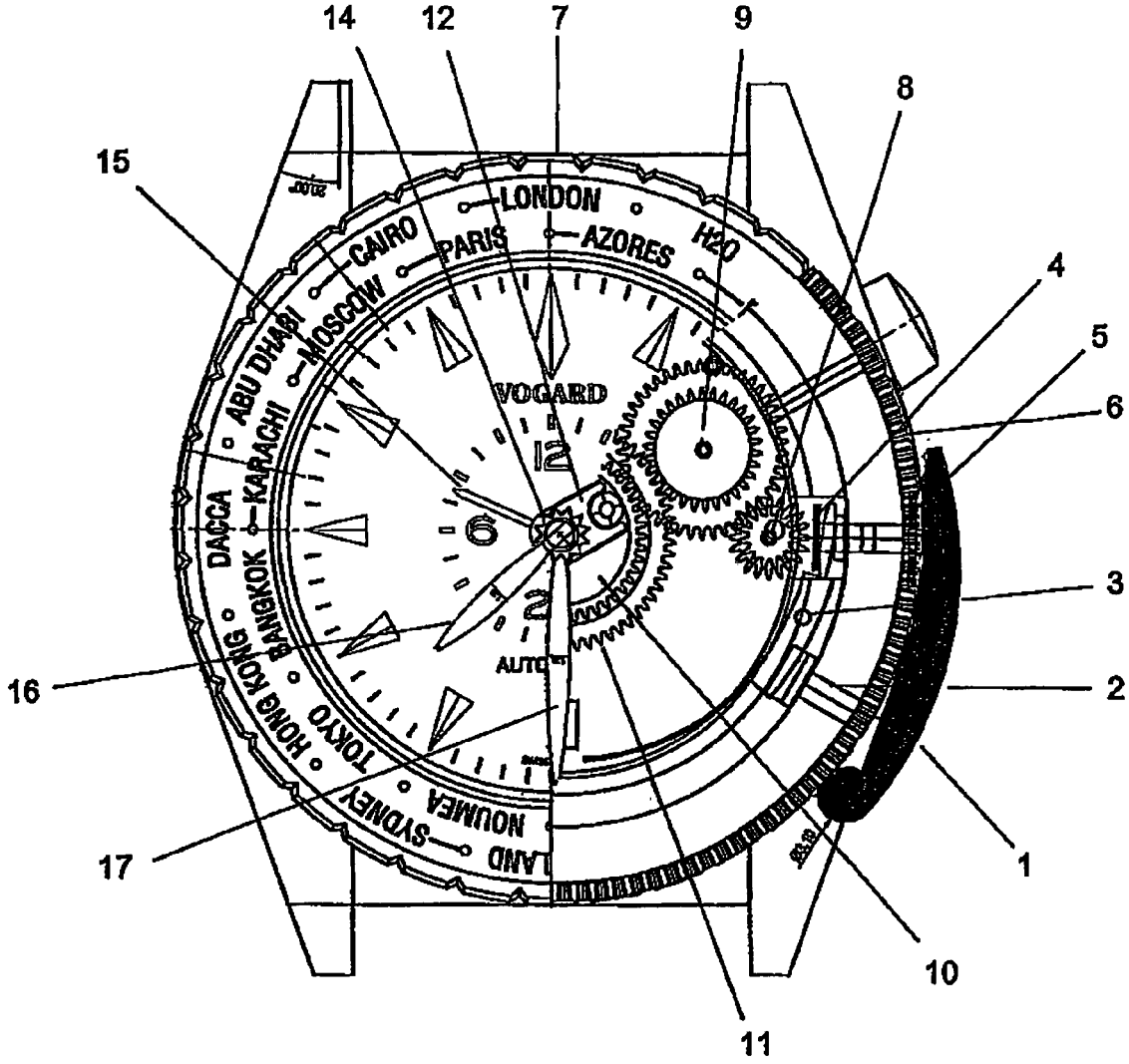
FIG. 2 shows the starting position of the timepiece, the mechanism is disengaged, the timepiece is set to London and displays the time of 07.30 a.m.

FIG. 2 shows the starting position. The lever (1) is closed and forces the push-piece (2) inward. The push-piece (2), for its part, actuates the clutch rocker (3), which, in this state, has disengaged the clutch pinion (4). The timepiece always shows the time at that destination which is set at 12 h and 24 h respectively. In FIG. 2, London is selected and the hands (15, 16, 17) show a time of 07.30 a.m.

Figure 3:
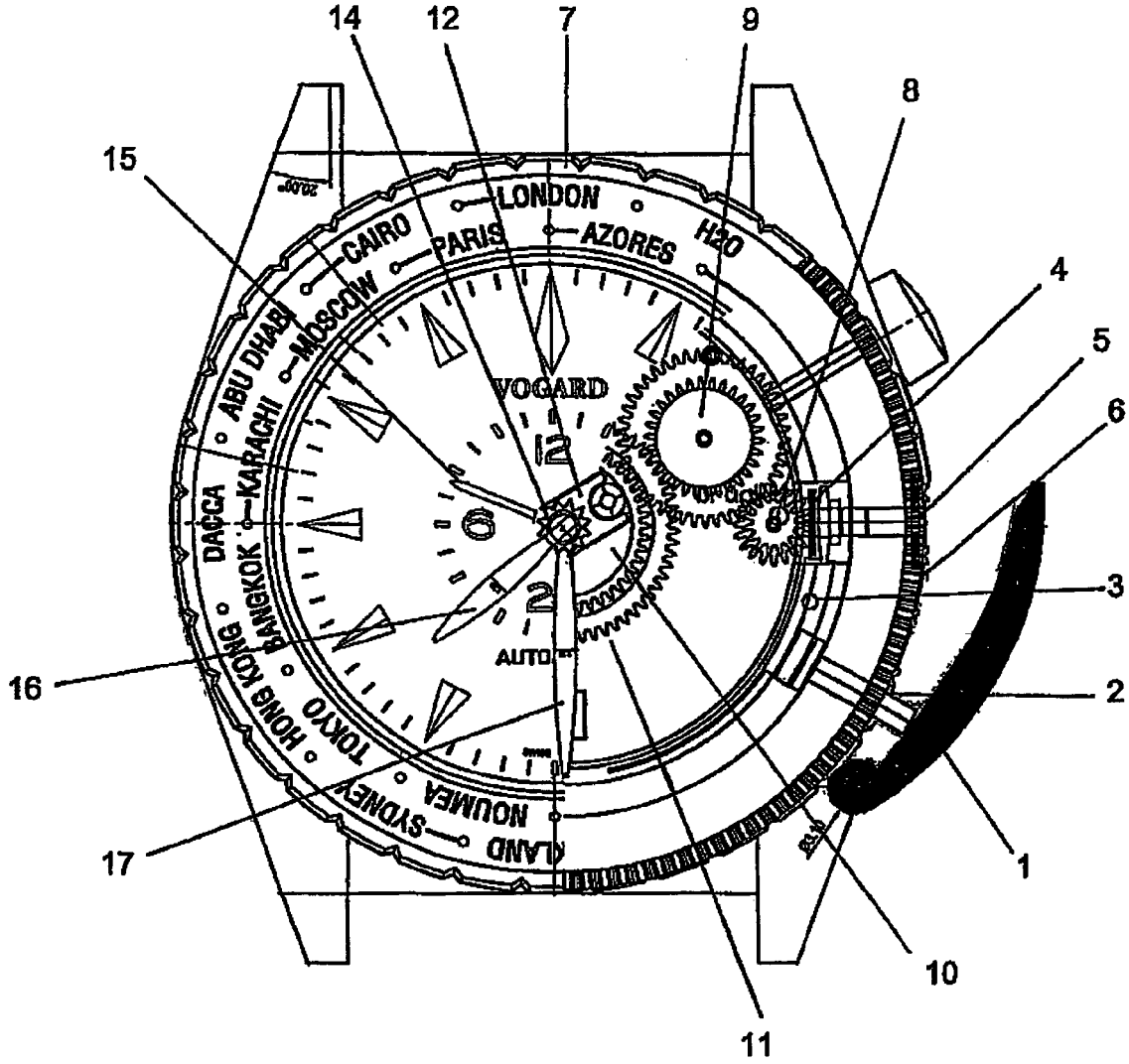
FIG. 3 shows the starting position of the timepiece, the mechanism is engaged, the turning ring can now be turned to the desired destination at 12 h.
Figure 4:
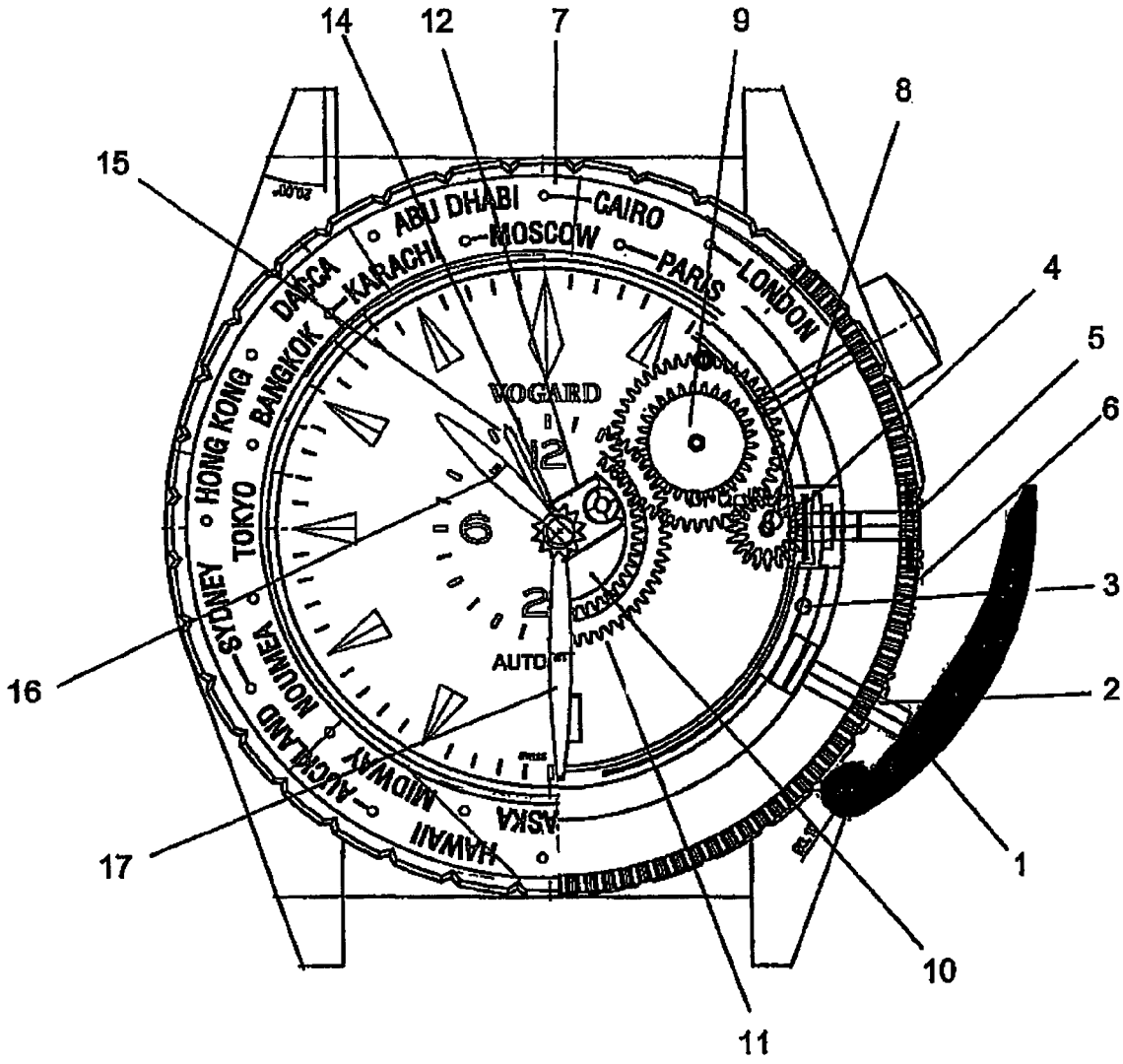
FIG. 4 shows the new time zone setting, after the turning ring has been turned 3 clicks to the right and the clock mechanism has thus been actuated. The timepiece is set to Moscow and shows a time of 10.30 a.m.

FIG. 3 shows the engagement mechanism. The lever (1) of the timepiece is opened. The following operations take place:

The lever (1) moves outward.

The push-piece (2) is released and is forced outward by its own spring.

The locking of the turning ring (7) with its gear rim (6) is thereby released.

The clutch rocker (3) is forced by the switching lever spring by one end against the inner part of the push-piece (2). If the push-piece (2) moves outward, the clutch rocker (3), forced by the switching lever spring, adopts the "engaged" position.

The other end of the switching lever engages the clutch pinion (4) and the clutch shaft, respectively, in the first change wheel (8). Located, fixedly connected, on this shaft is the outer gear wheel (5), which is engaged with the radial serrations (6) of the turning ring.

If the turning ring is now moved, the minute wheels (8, 9) is moved by means of the outer gear wheel (6) and the pinions (4, 5). The minute wheels, for their part, drive the hour change wheels (10, 11). (see FIG. 1)

The minute wheel (9) moves, simultaneously, a 12-hour change wheel (10) and a 24-hour change wheel (11).

In the bore of the 12-hour wheel, a forcipate double spring (=double collet (12) in FIGS. 1, 2, 3, 4, 5) is fastened such that it clasps with its two catches into a drive star (14) having twelve teeth/indentations. This pinion is securely fastened on the canon pinion of a chosen basic train.

If the 12-hour wheel (10) is moved by the mechanism described, the double spring of the collet (12) opens and the two catches respectively move on by the number of indentations corresponding to the number of time zones on the turning ring. Since the catch is fixedly connected to the 12-hour wheel (10), the 24-hour wheel also rotates along with the 12-hour-24-hour change wheel. The actual local time of the locality located at 12 h on the turning ring is thus always displayed.

The turning ring (7) can be moved in both directions. In the example in FIG. 4, the turning ring (7) is turned to the right to the destination 'Moscow'. With each turn, the hour hand (16) and the 24-hour hand (15) move forward in a 1 h-cycle. The timepiece now displays a time in Moscow of 10.30 a.m. The fine line to the left of Moscow on the turning ring indicates that Moscow has a summertime of +1 h. The user must therefore establish whether it is winter or summertime. If it is summertime, the user moves the turning ring (7) once more to the right. The timepiece would in this case display 11.30 a.m.

By closing the lever, the coupling mechanism is moved in the opposite direction and the clutch pinion (4) disengaged from the first change wheel (8). The shape and dimensions of the lever (1) and of the clutch rocker (3) are chosen such that the locking of the turning ring (7) is only ever released once the mechanism is engaged. Or conversely, the turning ring (7) is first locked and then the mechanism disengaged. An inadvertent desynchronization of the mechanism is thereby prevented.

Figure 7:
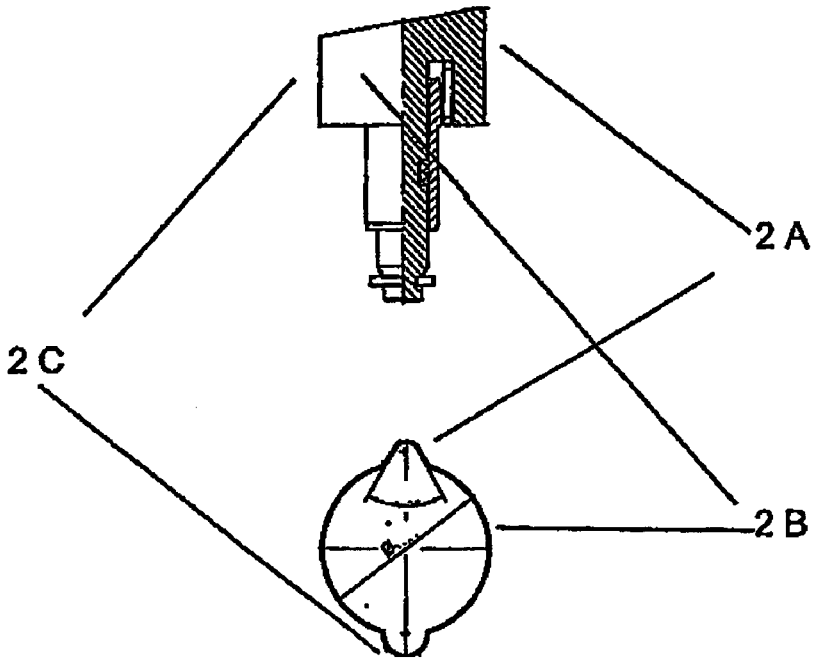
FIG. 7 shows a special push-piece with cross section and frontal section.

To prevent the turning ring (7) from being inadvertently moved when the lever (1) is in the closed state, a special push-piece shape has been designed (see FIG. 7), which has a double function. On the one hand, the push-piece actuates the clutch rocker (3) in FIGS. 1-5, and locks, by virtue of its shape, the gear wheel rim (6).

Figure 5:
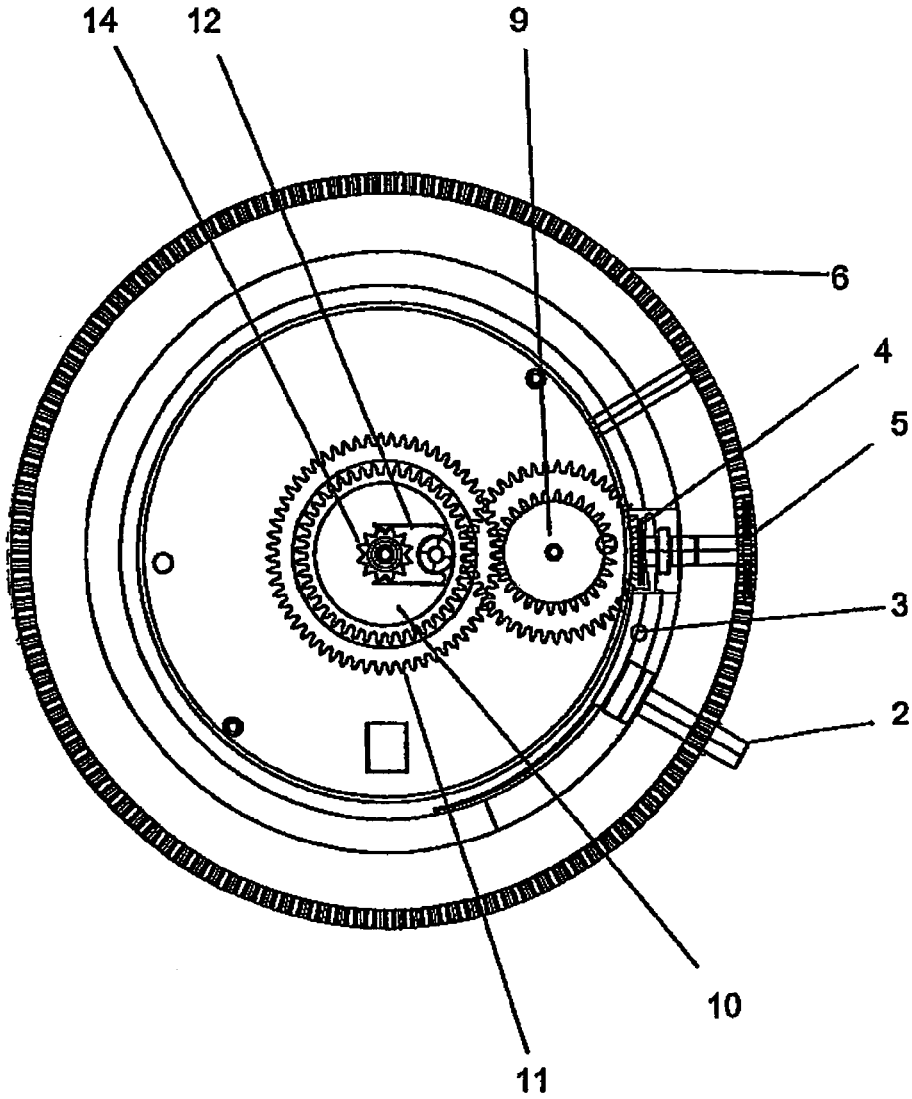
FIG. 5 shows an alternative design of the wheel train. When the turning ring is turned to the right, the time display is moved in the counterclockwise direction; when it is turned to the left, in the clockwise direction.

According to whether the user views the world in the direction of the South Pole or the North Pole, the destinations can be reversed. In FIGS. 1-4, the wheel train has been designed such that, when the turning ring is turned to the right, the hour hands jump forward, and when it is turned to the left, they jump back. FIG. 5 shows the wheel train in reverse form. As a result of the omission of a minute wheel, the 12-hour change wheel (10) and the 24-hour change wheel (11) are moved directly by the minute wheel (9). In this variant, the hour hands move in the reverse direction to the turning direction, i.e. when the turning ring is turned to the right, the hour hands jump back, and when it is turned to the left, they jump forward. The turning ring normally has 24 destinations, but can also, in alternative embodiments, have more destinations or fewer.

The timepiece has been designed such that the wheel train can also be coupled to a different display, particularly of the date, but also of the day of the week, the month or the year. If the wheel train is coupled to the date, the date jumps, respectively, one day forward or back as the turning ring is turned over the 24 h-threshold, according to the direction in which the turning ring has been turned.

The transmission mechanism in FIG. 1 can also, however, be used to ensure that the date, the day of the week, the month or the year can be adjusted directly via the turning ring, without being coupled to the time display. In these applications, the corresponding unit is adapted on the turning ring, e.g. 31 units for the date display, as well as the number of teeth on the gear rim and the wheel train.

A further application of the transmission mechanism in FIG. 1 is an integrated alarm, which can be set via the turning ring with a 24 h-display.

FIG. 6 shows that the turning ring consists of two parts. Of central importance is the turning ring insert (19), which is fastened by four screws (18). This design allows the turning ring insert (19) to be rapidly and easily exchanged. It is thus possible to personalize the turning ring insert by compiling the destinations according to customer requirement. According to customer requirement, therefore, the world timepiece can contain all important business destinations for a businessman, all important stock exchanges for a stockbroker, all the islands for an island lover or the names of all major golf courses in the world for a golfer.

The transmission mechanism in FIG. 1 has been built such that it can be connected to already existing clock movements, or can function as a component part of a completely innovative clock movement. The mechanism can also be connected, moreover, to a chronograph movement. In this case, the push-pieces are fitted on the left side of the housing. Alternatively, the transmission mechanism can also be used to ensure that the chronograph functions are actuated by the turning of the turning wheel.

The invention claimed is:

1. A world timepiece comprising a mechanical transmission system and a turning ring for adjusting a time display by actuating the mechanical transmission system, wherein the mechanical transmission system includes a gear rim fastened on the bottom side of the turning ring, a wheel train, which can be engaged and disengaged from outside a housing of the world timepiece, that interacts between the turning ring and hour hand provided for the time display, and engagement/disengagement mechanism with a clutch rocker is provided, and further wherein, the gear rim drives a drive wheel connected by a shaft to a clutch wheel, the turning ring can be turned both clockwise and counter clockwise, the time display is moved by the turning ring upon adjustment, the turning ring can be activated or deactivated via a locking device, and the timepiece is water tight.

2. The timepiece of claim 1, wherein the drive wheel drives at least one minute wheel, which moves at least one time display wheel and is determined by the number of teeth on a star rim.

3. The timepiece of claim 1, wherein the locking device comprises a lever which can be opened/closed and/or lock/unlock the turning ring and/or engage/disengage the transmission mechanism.

4. The timepiece of claim 1, wherein the shape and dimensions of the lever and of the clutch rocker are chosen such that the locking of the turning ring is only released once engagement has taken place and disengagement only occurs once the turning ring is locked.

5. The timepiece of claim 1, wherein a push-piece with a rounded portion for preventing turning and a boss for engaging in the gear rim is provided for locking the turning ring.

6. The timepiece of claim 1, wherein the turning ring can be latch-locked at twenty-four positions in accordance with time zones.

7. The timepiece of claim 1, wherein the display of the time at a desired locality denoted on the turning ring can be set by setting the locality denoted on the turning ring to the 12 o'clock position.

8. The timepiece of claim 1, wherein the turning ring has an exchangeable turning ring insert.

9. The timepiece of claim 1, wherein an additional wheel coupled to a date display is provided, so that, when a 24 hour threshold is breached, the date is automatically advances or put back by a turning of the turning ring.

10. The timepiece of claim 1, wherein the wheel train can be actuated with the turning ring for setting any combination of an alarm function, minutes, hours, or for winding a mechanical movement.

11. The timepiece of claim 1, wherein, for the time display, a 12-hour hand and/or a 24-hour hand and/or a daytime disk having at least two daytimes and/or a minute hand and/or a 12-hour disk and/or a 24-hour disk is provided.

12. The timepiece of any one of claims 1, 2, 3, and 11, wherein the time is also displayed in a half-hour cycle and the number of teeth on each transmission wheel is adapted appropriately.

* * * * *